United States Patent [19]

Shubow

[11] Patent Number: 4,616,459

[45] Date of Patent: Oct. 14, 1986

[54] BUILDING CONSTRUCTION USING HOLLOW CORE WALL

[76] Inventor: Calvin Shubow, 30995 Hunter's Dr., Farmington, Mich. 48024

[21] Appl. No.: 619,627

[22] Filed: Jun. 11, 1984

Related U.S. Application Data

[63] Continuation-in-part of Ser. No. 268,598, May 29, 1981, Pat. No. 4,461,130.

[51] Int. Cl.[4] ..... E04H 1/00

[52] U.S. Cl. ..... 52/309.12; 52/236.8; 52/743; 52/747; 52/309.8

[58] Field of Search ..... 52/309.4, 309.8, 309.9, 52/309.11, 309.12, 309.17, 236.6, 236.7, 236.8, 236.9, 741, 745, 746, 747, 251, 264, 612, 408, 410, 597, 598

[56] References Cited

U.S. PATENT DOCUMENTS

| | | | |
|---|---|---|---|
| 1,251,830 | 1/1918 | Siegfried | 220/445 |
| 3,492,196 | 1/1970 | Moore | 52/309.12 |
| 3,533,204 | 10/1970 | Wallace | 52/236.7 |
| 3,638,381 | 2/1972 | Robertson | 52/309.12 |
| 3,656,577 | 4/1972 | Larsson | 52/599 |
| 3,950,902 | 4/1976 | Stout | 52/264 |
| 4,010,581 | 3/1977 | Keturi | 52/259 |
| 4,015,387 | 4/1977 | Tillie | 52/309.17 |
| 4,018,021 | 4/1977 | Dow | 52/251 |
| 4,185,437 | 1/1980 | Robinson | 52/309.17 |
| 4,398,378 | 8/1983 | Heitzman | 52/251 |
| 4,438,611 | 3/1984 | Bryant | 52/410 |
| 4,455,794 | 1/1984 | MacKinnon | 52/741 |
| 4,461,130 | 7/1984 | Shubow | 52/236.6 |

FOREIGN PATENT DOCUMENTS

| | | | |
|---|---|---|---|
| 2134533 | 2/1973 | German Democratic Rep. | 52/251 |
| 2443825 | 4/1975 | German Democratic Rep. | 52/612 |
| 2444752 | 4/1976 | Fed. Rep. of Germany | 52/309.1 |

*Primary Examiner*—Henry E. Raduazo

*Attorney, Agent, or Firm*—Krass and Young

[57] ABSTRACT

A concrete building formed of precast cored wall and floor slabs and precast cored bond beams. The precast members are manufactured at a remote factory location and transported to the building site where the wall slabs are erected side by side and the bond beams placed along the tops of the wall slabs with a downwardly opening groove in the lower face of the bond beams seating the upper edges of the wall slabs and the cores in the bond beams vertically aligned with the cores in the wall slabs. The ends of the floor slabs are then placed on the bond beams in a position spaced from the innerface of an outer flange portion of the bond beams, and clear of the aligned cores, to form an upwardly opening trough. Vertical reinforcing rods are positioned in the vertically aligned cores of the bond beams and wall slabs, a horizontal reinforcing rod is placed in the upwardly opening trough, auxiliary rods are placed in the spaces between the adjacent floor slabs and extend into the trough, and cement is poured into the aligned cores, the trough, and the floor slab spaces to embed the various rods in the poured cement and form a rigid unitary building structure. Insulating panels are secured to at least certain of the wall slabs at the remote factory location so that the wall slabs may be placed side by side with the insulating panels on the exterior of the slabs to form a building having a preformed exterior insulation layer.

17 Claims, 9 Drawing Figures

Fig-1
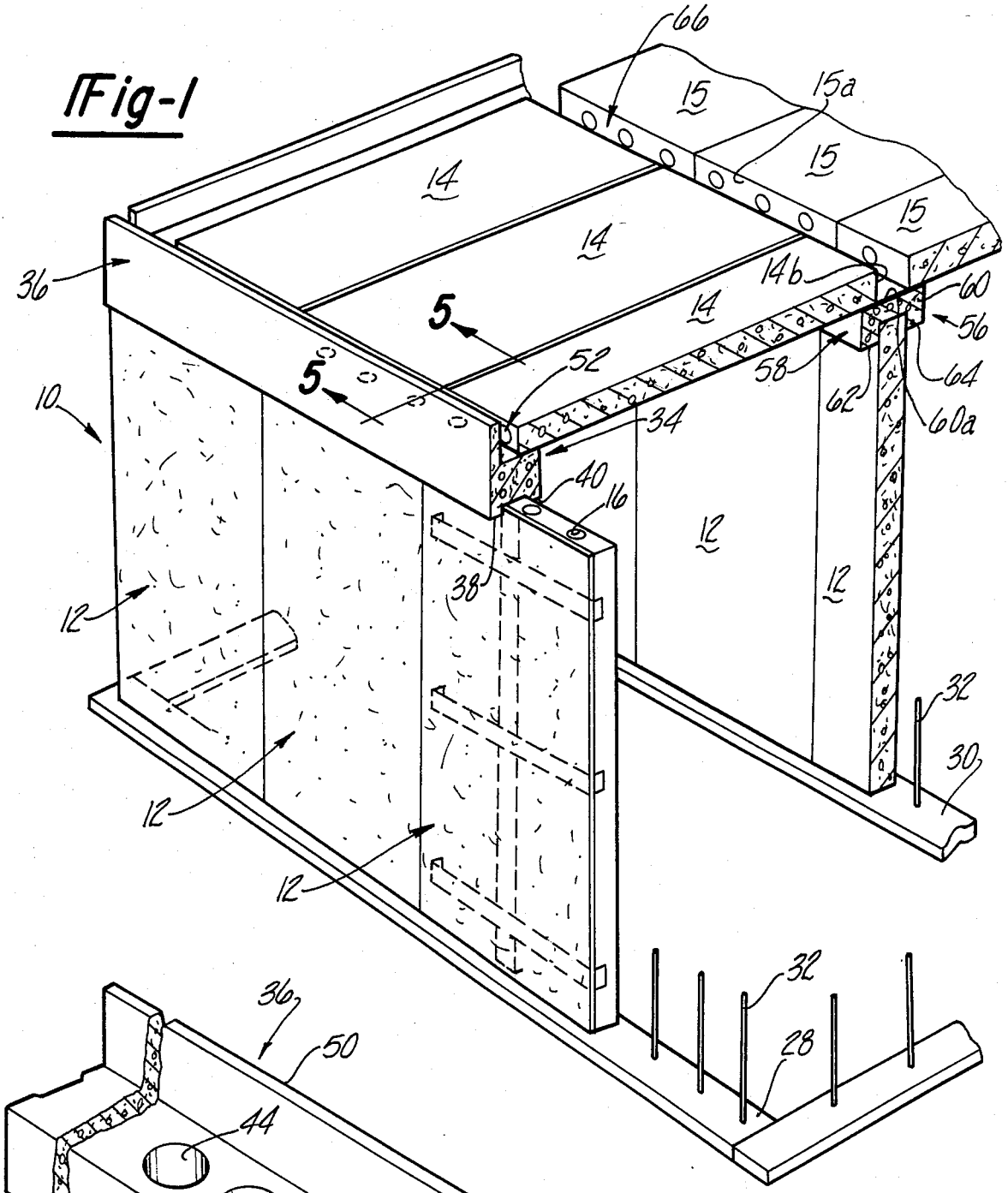
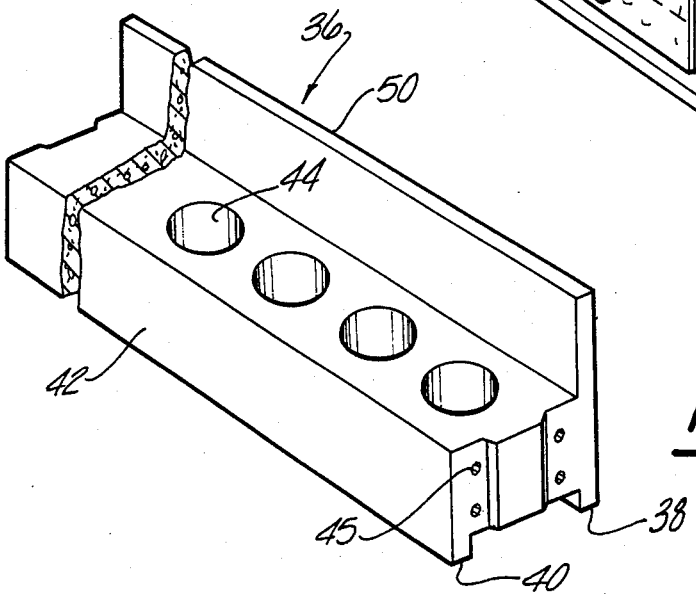
Fig-2

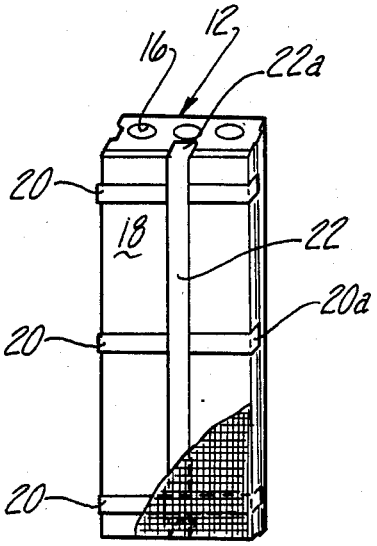
Fig-3
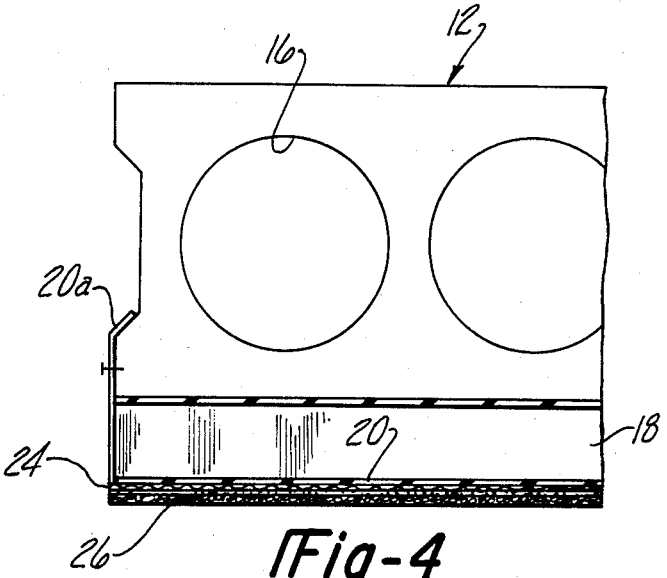
Fig-4
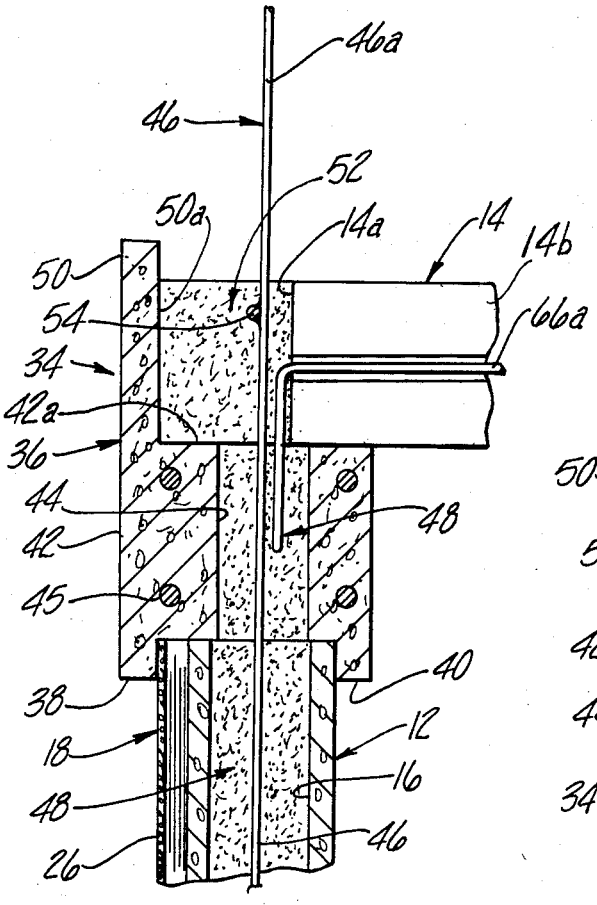
Fig-5
Fig-6
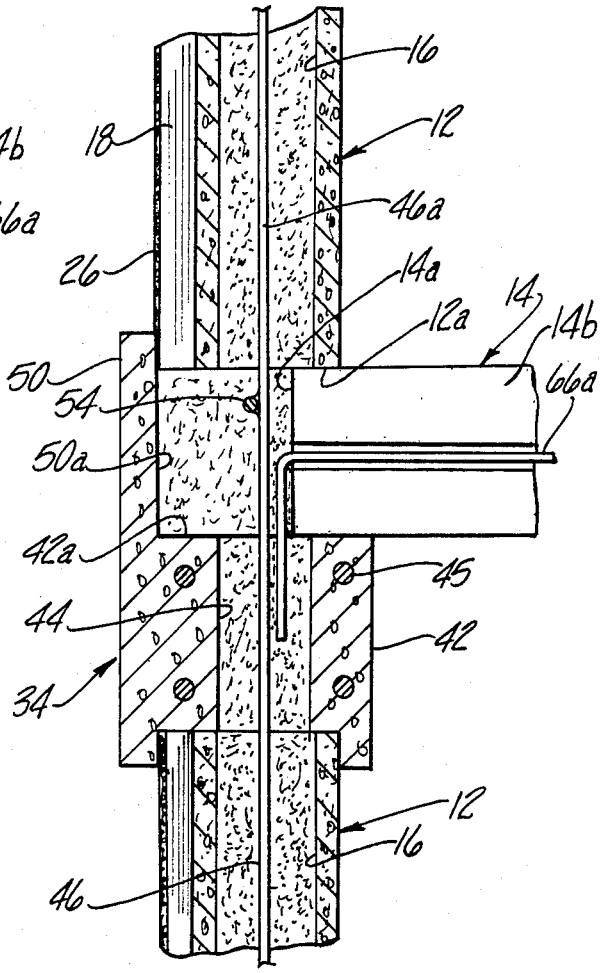

BUILDING CONSTRUCTION USING HOLLOW CORE WALL

This application is a continuation-in-part of U.S. patent application Ser. No. 268,598 filed May 29, 1981 now U.S. Pat. No. 4,471,130.

BACKGROUND OF THE INVENTION

This invention relates to buildng constructions and, more particularly, to building constructions utilizing precast concrete slabs with hollow core channels.

Precast concrete slabs with hollow core channels are often used as floors in multistory buildings. The hollow cores are designed to provide passageways for utility cables and the like. The cored slabs are relatively inexpensive and readily available from a variety of sources. The prior art has contemplated using these cored slabs as both the floor panels and upstanding walls for a building. Such a construction is shown in U.S. Pat. No. 4,010,581 to Kenturi et al. In that patent the cores are used for routing utility cables through the building. U.S. Pat. No. 3,710,527 to Farebrother illustrates the use of the core channels to hold vertical reinforcement rods extending the entire height of the building.

Those skilled in the art will appreciate that the joining together of the structure walls and floors is one of the most important procedures in building a rigid, structurally sound multistory building. Unfortunately, it is also one of the most time consuming and expensive steps both in terms of labor and material costs. A reading of the above-mentioned patents illustrates that great care must be taken to insure that these joints are made properly. In the Kenturi et al patent additional vertical opening must be formed in the floor slabs to permit communication between the cores in the vertical wall slabs. Farebrother's floor slabs must be provided with specially formed castellated end which interlock at the joints.

The structural soundness of a multistory building is, of course, of primary concern. Reinforcement rods have been used in the past as one means for increasing the rigidity of the resultant structure. Some prefabricated concrete slabs have reinforcement rods embedded in them during fabrication. These sbas are often designed for specific uses and do not readily lend themselves to multi-purpose applications such as the use of the slabs for walls as well as the floors.

OBJECTS AND SUMMARY OF THE INVENTION

It is an object of this invention to provide an extremely rigid multistory building construction using precast concrete slabs with hollow core channels.

It is a further object of this invention to provide such a building construction at relatively low cost both in terms of labor and material costs.

The building utilizes precast concrete wall slabs having a plurality of parallel core channels extending vertically therethrough; precast concrete bond beams having at least one core channel extending vertically therethrough; and reinforcing rods. According to the invention building construction, a bond beam is positioned on and extending along the top edge of a wall slab with the core channels in the bond beam aligned with a selected core channel in the wall slab to form a continuous vertical core passage, and a vertically extending reinforcing rod is positioned in the continuous core passage and locked to the wall slab and bond beam by poured concrete filling the core channel in the bond beam and filling at least the upper portion of the selected core channel in the wall slab.

According to a further feature of the invention building construction, the wall slab forms an outer wall of the building, the bond beam includes a main body portion through which the core channel extends and a flange portion extending upwardly from the main body portion adjacent the outer edge thereof; the reinforcing rod extends upwardly above the upper face of the main body portion; and at least one precast concrete floor slab rests on its outer end on the upper face of the main body portion of bond beam with its outer vertical face spaced from the inner vertical face of the flange portion of the bond beam to form a trough into which the upward extension of the reinforcing rod extends and into which concrete is poured to embed the upward rod extension.

According to a further feature of the invention, the building construction further includes another reinforcing rod extending horizontally in the trough and embedded in the concrete filling the trough.

According to yet another feature of the invention, the vertically extending reinforcing rod extends upwardly above the face of the floor slab and another vertically cored, precast wall slab is positioned with its lower edge resting on the upper face of the floor slab with the upward extension of the vertical reinforcing rod extending upwardly into a vertical core channel in the upper wall slab and locked in position within that core channel by poured concrete filling at least the lower portion of the core channel.

According to another feature of the invention, the precast concrete wall slabs are formed at a manufacturing location remote from the building site; a heat insulative panel is secured at the manufacturing site to a vertical face of each wall slab; the slabs with the secured insulative panels are transported to the building site; and the slabs are erected side by side at the building site to form the walls of the building with the heat insulative panels positioned at the outer surface of the slab to form a heat insulative barrier extending around the exterior of the building.

BRIEF DESCRIPTION OF THE DRAWINGS

FIG. 1 is a fragmentary perspective view of a building construction according to the present invention;

FIG. 2 is a fragmentary perspective view of a bond beam employed in the invention building construction;

FIG. 3 is a perspective view of a precast concrete wall slab having an insulative panel secured to its exterior face;

FIG. 4 is a fragmentary top view of the slab and insulative panel of FIG. 3;

FIG. 5 is a cross-sectional view taken on line 5—5 of FIG. 1;

FIG. 6 is a cross-sectional view similar to FIG. 5 but showing, additionally, an upper story wall slab;

DESCRIPTION OF THE PREFERRED EMBODIMENT

Figure 7:
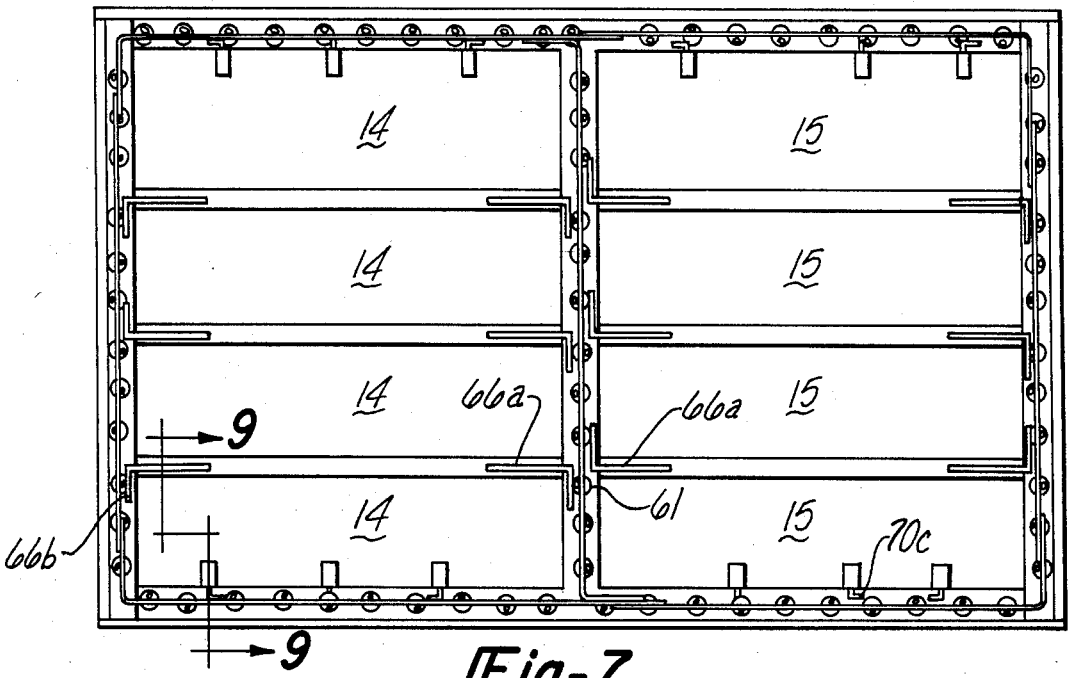
FIG. 7 is a top view of a building constructed according to the invention.

FIG. 1 shows a building formed of a plurality of vertical wall slabs 12 and horizontal floor slabs 14 and 15. Floor slabs 14 and 15 may constitute the ceiling of a lower floor in a multi-story building or may constitute a roof structure. Slabs 12, 14 and 15 are formed of precast concrete at a factory manufacturing location remote from the building site. Slabs 12, 14 and 15 include a plurality of parallel core channels 16 which extend from one edge of the slab to an opposite edge of the slab between the side faces of the slab.

As best seen in FIGS. 1, 3 and 4, an insulation panel 18, of Styrofoam or other heat insulative material, is secured at the factory to one vertical face of the wall slabs 12 intended for use in forming the outside walls of the building. Each panel 18 is adhesively secured to the vertical face of the wall slab and is also held to that face by a plurality of mesh attachment straps. Specifically, a plurality of mesh straps 20 extend in parallel spaced relation across the outer face of panel 18 and at least one mesh strap 22 extends vertically along the outer face of panel 18. Ends 20A of straps 20 are adhesively secured to the vertical edge faces of slab 12 and the ends 22A of strap 22 are adhesively secured to the top and bottom edge faces of slab 12. A binder layer 24 is sprayed over panel 18 to cover straps 20, 22 and a finish coat 26 of suitable aggregate material is sprayed over binder layer 24 to form the exterior finish for the slab.

Wall slabs 12 are placed side by side on suitable outer and inner foundation structures 28, 30 with spaced upstanding reinforcement rods 32 embedded in foundation structures 28, 30 passing upwardly into core channel 16 to assist in aligning the wall slabs on the foundation structures. The wall slabs 12 positioned on the outer foundation structure 28 include secured insulation panels 18 and are arranged with the insulation panels on the exterior surface of the building. Plain wall slabs 14 are positioned on inner foundation structure 30.

Exterior wall slabs 12 are connected to floor slabs 14 by a joint seen generally at 34. Joint 34 employs a horizontally extending precast bond beam 36 formed at the remote factory location. Bond beam 36, as best seen in FIGS. 5 and 6, includes two spaced downwardly extending flange portions 38 and 40 which form a downwardly opening groove to seat the upper edges of wall slabs 12 and attached insulation panels 18. Bond beam 36 may be made of a variety of lengths but, preferably, is of sufficient length to bridge two adjacent wall slabs. Bond beam 36 further includes a main body portion 42 having one or more core channels 44 extending vertically therethrough and one or more reinforcement rods 45 embedded horizontally therein. Bond beam 36 is positioned on the upper edges of wall slabs 12 with core channels 44 aligned with core channels 16 in wall slabs 12. Vertically extending reinforcement rods 46 are positioned in aligned core channels 44,16 and embedded in poured concrete columns 48 filling core channels 16 and 44.

Bond beam 36 further includes a flange portion 50 extending upwardly from main body portion 42 adjacent the outer edge of the main body portion.

Floor slabs 14 rest on their outer ends on the inner portion of the upper surface 42*a* of main body portion 42 of beam 36. The outer vertical faces 14*a* of the floor slabs are spaced from the inner vertical face 50*a* of beam upper flange portion 50 so as to not substantially obstruct core channels 44 and so as to form an upwardly opening trough 52 defined by surfaces 50*a*, 42*a* and 14*a*. One or more horizontally extending reinforcement rods 54 are positioned in trough 52 and trough 52 is filled with poured concrete to embed rod 54 and rods 46.

In the case of a multi-story building, the upwardly extending projections 46A of vertical reinforcement rods 46 pass upwardly into core channels 16 of upper wall slabs 12 with lower edges 12*a* of the upper wall slabs resting on the upper surface of the outer ends of floor slabs 14 and the aggregate surface 26 of the upper wall slabs abutting inner surface 50*a* of bond beam upper face portion 50.

Interior wall slabs 12 positioned on interior foundation structures 30 are interconnected to floor slabs 14, 15 by a joint seen generally at 56. Joint 56 employs an interior bond beam 58 including a main body portion 60, core channels 61, and spaced downwardly extending flange portions 62, 64 which form a downwardly opening groove to seat the upper edges of interior wall slabs 14. The inner end of slabs 14 and 15 rest on the top surface 60*a* of main body portion 60 with the inner edge surface 14*b* of slabs 14 spaced from the inner edge surfaces 15*a* of slabs 15 to form a trough 66 defined by surfaces 14*b*, 60*a*, and 15*a*.

Figure 8:
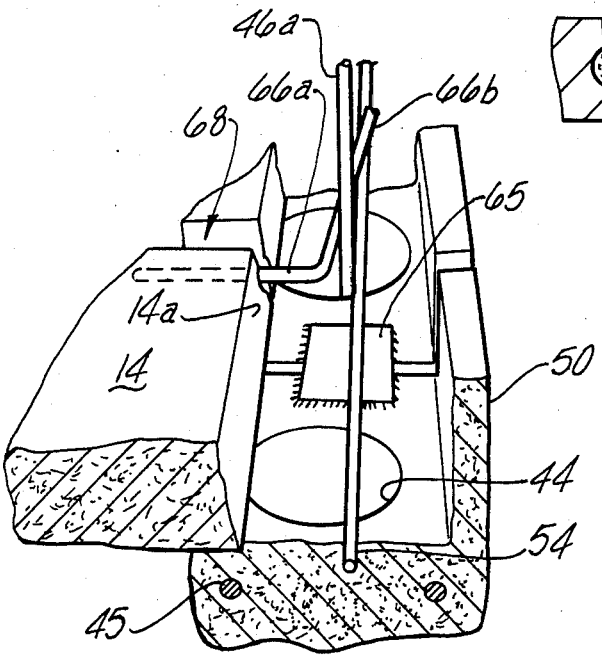
FIG. 8 is a fragmentary perspective view showing details of the invention bond beam construction.

The building 10 of the present invention may be readily constructed as follows. Wall slabs 12, floor slabs 14 and 15, and beams 36 are precast at a remote manufacturing site; panels 18 are secured to selected wall slabs 12; and the slabs and beams are transported to the building site. The wall slabs 12 with attached panels 18 are then placed side by side on foundation structure 28, using rods 32 for alignment purposes, with panels 18 facing outwardly. As the slabs are lowered onto the foundation, lower ends 22 of straps 22 are trapped between the lower end of the slab and the foundation and, as adjacent slabs are moved into abutting relationship, ends 20*a* of straps 20 are trapped between the juxtaposed vertical edge faces of the slabs to preclude dislodgment of panels 18 from the slabs 12. Beams 36 are now lowered into place over the top edges of slabs 12 with beam flanges 38 and 40 seating the upper ends of the slabs and the attached insulating panels; with the core channels 44 in the beam aligned with the core channels 16 in the slab; and with upper strap ends 22*a* trapped between the beam and the upper edge surfaces of the slabs. Beams 36 are sized and arranged to insure that one beam spans each juncture betweeen adjacent wall slabs so that the beam flanges assist in the alignment of the adjacent wall slabs. Weld plates 65 (FIG. 8) are preferrably employed at the joints between adjacent beams 36. Weld plates 65 are metallic and are welded to rod sections or other metallic pieces embedded in the beams in the precasting process at the remote manufacturing location.

Figure 9:
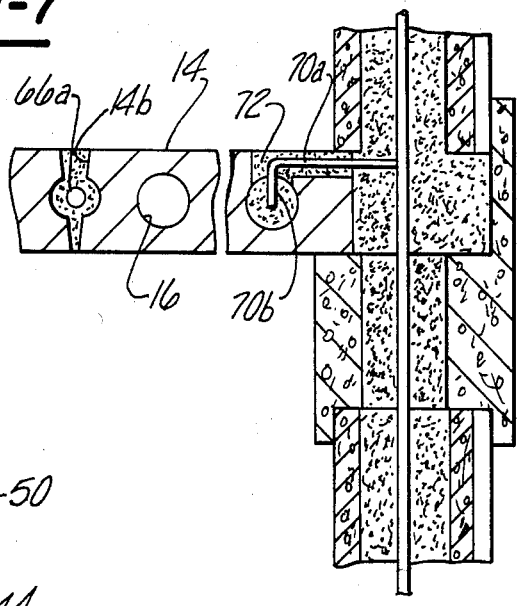
FIG. 9 is a cross-sectional view taken on line 9—9 of FIG. 7.

Floor slabs are now positioned with their one ends resting on the upper surface 42*a* of beams 36 in a position spaced from beam flange inner surface 50*a* and clearing channels 44. Vertical reinforcement rods 46 are now positioned in aligned core channel 16 and 44; horizontal rods 54 are positioned in trough 52; and auxiliarily rods 66 (FIGS. 7, 8 and 9) are placed in the spaces defined between the chamfered edge faces 14*b* of adjacent floor slabs. Vertical rods 46 may extend all the way down core channel 16 to the foundation structure for attachment to the foundation structure or to rods 32, or may extend only part way down the core channel. In the case of a multi-story building, rods 46 will include an upper portion 46*a* extending above the level to floor slabs 14. Auxiliary rods 66 are bent, right angle members including a main body portion 66*a* positioned in space 68 and a bent or hooked portion 66*b*. Depending on its location and the number of stories in the building, hook portion 66*b* may extend horizontally in trough 52, downwardly into a beam core channel 44, or upwardly into a wall slab core channel 16. After all of the reinforcement rods are in place, core channels 16 and 44, trough 52, and spaces 68 are filled with poured concrete to form a cement column in core channels 16 and 44 embedding rods 32 and 46; to fill trough 52 with cement embedding horizontal rods 54 and hook ends 66*b* of auxiliarly rods 66; and to embed auxiliary rod main body portions 66*a* in spaces 68.

The other ends of floor slabs 14 are supported on a simultaneously erected wall structure which may comprise the interior wall erected on interior foundation 30 as in FIG. 1 or may, in the case of a relatively narrow building, comprise an exterior wall structure. In the case of the interior wall structure of FIG. 1, wall slabs 12, without insulation panels 18, are erected side by side on the foundation 30 utilizing rods 32 for alignment; bond beams 58 are placed over the top edges of the aligned wall slabs; the inner ends of floor slabs 14 and 15 are spacedly positioned on the upper surface 60*a* of the beam; a horizontal reinforcement rod 54 is placed in trough 66; vertical rods 46 are positioned in aligned core channel 16 and 61; auxiliary rods 66 are placed in spaces 68 with hook portions 66*b* extending into trough 66 or into core channels 16 or 61; and cement is poured to fill core channels 16 and 61, trough 66, and spaces 68.

Considering a total building structure as seen in top view in FIG.7, horizontal reinforcement rods 54 are preferrably bent structures which extend in troughs 52 around at least one corner of the building and are secured to other rods 54 (by welding, clips, or screw fittings) to form a complete circular structure extending around the total perimeter of the building and serving to tie the building together. In the structure of FIG. 7, the horizontal rod 54 positioned in space 66 between slabs 14 and 15 includes hook portions 54*a* at either end which are suitably tied into the loop structure formed by the rods 54 positioned in troughs 52 to further unitize and tie together the total building structure. Also, further auxiliary rods 70 are preferrably employed along the longitudinal sides of the slabs 14, 15 bordering the perimeter of the building. Rods 70 are multi-bend structures and are positioned in outwardly opening channels 72 formed on the job in slabs 14 and 15 in a cutting or grinding operation. Channels 72 are deep enough and extend inwardly from the edge of the slab far enough to break through into a core channel 16. Each rod 70 includes a main body portion 70*a* positioned in channel 72, a hooked end portion 70*b* extending downwardly into the exposed core channel 16, and a hooked end portion 70*c* extending into trough 52 and suitably tied into the reinforcement rod assembly. Channels 72 are filled with poured concrete to embed auxiliary rods 70 therein.

If a multi-story buiding is contemplated, vertical rods 46 are sized to extend upwardly to provide extensions 46*a* for alignment of wall slabs 12 of the next floor and a building procedure similar to the described sequence is followed to form the next and succeeding floors.

The described construction provides a simple building having excellent structural rigidity and excellent heat insulative qualities; and the building is provided at relatively low cost since inexpensive precast members are extensively used and the joints between the precast members are formed on the job in a relatively simple operation requiring minimal and relatively unskilled labor.

Whereas a preferred embodiment of the invention has been illustrated and described in detail, it will be apparent that various changes may be made in the described embodiment wihout depending from the scope of spirit of the invention.

I claim:

1. A building construction comprising:

(A) at least one precast concrete wall slab positioned vertically and having a plurality of generally parallel core channels extending vertically therethrough from the lower edge thereof to the upper edge thereof between opposite side faces thereof;

(B) at least one precast concrete bond beam positioned on and extending generally horizontally along the top edge of said wall slab and having at least one core channel extending vertically therethrough and aligned with a selected core channel in said precast slab to form a continuous vertical core passage extending from the upper face of said bond beam substantially to the lower edge of said wall slab;

(C) a vertically extending reinforcing rod positioned in said continuous core passage and extending within said core passage from substantially the lower edge of said wall slab to the upper face of said bond beam;

(D) poured concrete filling said core channel in said precast bond beam to lock said reinforcing rod to said bond beam and filling said core channel in said precast slab to lock said reinforcing rod to said precast slab and form a concrete, rod-reinforced column extending from substantially the lower edge of said wall slab to the upper face of said bond beam; and (E) at least one precast concrete floor slab extending horizontally and at right angles with respect to the plane of said wall slab and resting at one end thereof on said bond beam with its vertical end edge disposed intermediate the width of said bond beam.

2. A building construction accordingly to claim 1 wherein (L) said vertically extending reforcing rod extends upwardly above the upper face of said slab; and (M) said building construction further includes (1) another vertically cored, precast concrete wall slab positioned with its lower edge resting on the upper face of said floor slab adjacent the outer edge of said floor slab with the upward extension of said vertically extending rod extending upwardly into a vertical core channel of said other slab, and (2) poured concrete filling at least the lower portion of said vertical core of said other wall slab to embed the upward extension of said vertically extending rod in said other slab.

3. A building construction comprising:

(A) at least one precast concrete wall slab positioned vertically and having a plurality of generally parallel core channels extending vertically therethrough from the lower edge thereof to the upper edge thereof between opposite side faces thereof;

(B) at least one precast concrete bond beam positioned on and extending generally horizontally along the top edge of said wall slab and having at least one core channel extending vertically therethrough and aligned with a selected core channel in said precast slab to form a continuous vertical core passage;

(C) a vertically extending reinforcing rod positioned in said continuous core passage;

(D) poured concrete filling said core channel in said precast bond beam to lock said reinforcing rod to said bond beam and filling at least the upper portion of said core channel in said precast slab to lock said reinforcing rod to said precast slab;

(E) at least one precast concrete floor slab extending horizontally and at right angles with respect to the plane of said wall slab and resting at one end thereof on said bond beam;

(F) said precast wall slab forming an outer wall of said building construction;

(G) said bond beam including (1) a main body portion through which said core channel extends and having an upper face; and (2) a flange portion extending upwardly from said main body portion adjacent the outer edge thereof to define an inner vertical face;

(H) said reinforcing rod extending upwardly above said upper face of said main body portion;

(I) said floor slab extending inwardly from said bond beam and resting at its outer end on said upper face of said main body portion of said bond beam and including an end face spaced from said inner vertical face of said flange portion to form, in cooperation with said upper face of said main body portion, an upwardly opening trough into which the upward extension of said reinforcing rod extends;

(J) poured concrete filling said trough and embedding the upward extension of said reinforcing rod; and (K) another reinforcing rod extending horizontally in said trough and embedded in the poured concrete filling said trough.

4. A building construction according to claim 3 wherein (N) there are a plurality of floor slabs arranged side by side with lateral spacing therebetween;

(O) further reinforcing rods are respectively positioned in the lateral spaces between the floor slabs and extend outwardly into said trough where they bend at right angles to form a hook portion embedded in the poured concrete in the trough; and (P) poured concrete fills the lateral spaces between the floor slabs to embed said further reinforcing rods.

5. A building construction according to claim 4 wherein certain of said hook portions extend embeddedly downwardly into a vertical core in said bond beam.

6. A building construction accordingy to claim 4 wherein certain of said hook portions extend in embeddedly upwardly into a vertical core in said other slab.

7. A building construction construction according to claim 4 wherein certain of said hook portions extend horizontally along said trough.

8. A building construction comprising:

(A) at least one precast concrete wall slab positioned vertically and having a plurality of generally parallel core channels extending vertically therethrough from the lower edge thereof to the upper edge thereof between opposite side faces thereof;

(B) at least one precast concrete bond beam positioned on and extending generally horizontally along the top edge of said wall slab and having at least one core channel extending vertically therethrough and aligned with a selected core channel in said precast slab to form a continuous vertical core passage extending from the upper face of said bond beam substantially to the lower edge of said wall slab;

(C) a vertically extending reinforcing rod positioned in said continuous core passage and extending within said core passage from substantially the lower edge of said wall slab to the upper face of said bond beam;

(D) poured concrete filling said core channel in said precast bond beam to lock said reinforcing rod to said bond beam and filling said core channel in said precast slab to lock said reinforcing rod to said precast slab and form a concrete, rod reinforced column extending from substantially the lower edge of said wall slab to the upper face of said bond beam;

(E) at least one precast concrete floor slab extending horizontally and at right angles with respect to the plane of said wall slab and resting at one end thereof on said bond beam;

(F) said precast wall slab forming an outer wall of said building construction;

(G) said bond beam including (1) a main body portion through which said core channel extends and having an upper face; and (2) a flange portion extending upwardly from said main body portion adjacent the outer edge thereof to define an inner vertical face;

(H) said reinforcing rod extending upwardly above said upper face of said main body portion;

(I) said floor slab extending inwardly from said bond beam and resting at its outer end on said upper face of said main body portion of said bond beam and including an end face spaced from said inner vertical face of said flange portion to form, in cooperation with said upper face of said main body portion, an upwardly opening trough into which he upward extension said reinforcing rod extends; and (J) poured concrete filling said trough and embedding the upward extension of said reinforcing rod.

9. A building construction according to claim 8 wherein (K) said bond beam further includes a downwardly extending flange portion against which said wall slab may be abutted.

10. A building construction according to claim 8 wherein (L) said bond beam includes a pair of downwardly extending flange portions forming, in coaction with the under surface of said main body portion, a downwardly opening groove into which the upper end of said wall slab may be fitted.

11. A building construction comprising;

(A) a plurality of precast concrete wall slabs positioned side by side to form an outer wall of the building construction;

(B) a plurality of panels of heat insulative material conforming in size and shape to said slabs; and (C) elongated flexible straps extending horizontally across the outer face of each of said slabs to secure each of said panels to the outer face of a respective slab and including end portions securely interposed in the joints between adjacent slabs.

12. A building construction comprising:

(A) a plurality of precast concrete wall slabs positioned side by side to form an outer wall of the building construction;

(B) a plurality of panels of heat insulative material conforming in size and shape to said slabs;

(C) strap means extending horizontally across the outer face of each of said slabs to secure each of said panels to the outer face of a respective slab and including end portions securely interposed in the joints between adjacent slabs;

(D) bond beams positioned on and extending along the top edges of said wall slabs; and (E) further strap means extending vertically along the outer face of each of said panels and including lower end portions clampingly positioned beneath the bottom edge of the respective slab and upper end portions interposed between the top edge of the respective slab and the overlying bond beam.

13. A building construction accordingly to claim 12 wherein (E) said building construction further includes an aggregate exterior finish coat covering the outer face of each insulative panel and said strap means.

14. A method of constructing a building employing precast concrete slabs having side faces and end faces and a plurality of generally parallel core channels extending therethrough from one end thereof to an opposite end thereof, said method comprising the steps of (A) forming a plurality of precast concrete slabs at a manufacturing location remote from the building site;

(B) thereafter, at said manufacturing location, securing a panel of heat insulative material to a vertical face of each of said slabs by the use of elongated flexible straps extending arcoss the outer face of said panel;

(C) thereafter transporting said slabs with said secured insulative panels to the building site; and (D) erecting said slabs side by side at said site to form the outer walls of said building with said core channels extending vertically and said insulative panels positioned at the outer surfaces of said slabs to form a heat insulative barrier around the exterior of said building and the end portions of said straps securely interposed in the joints between adjacent slabs.

15. A method accordingly to claim 14 wherein (E) following said securement step, an aggregate is applied over the outer surface of said insulative panels to form an exterior coat for said building.

16. A method according to claim 15 wherein said aggregate is sprayed over the outer surface of said insulative panels.

17. A method according to claim 14 wherein (E) said securing step comprises passing said straps across each panel and adhesively securing the ends of the straps to the vertical edge faces of the respective slab so that as said slabs are erected side by side at the building site the ends of the straps are securedly interposed in the vertical joints between the adjacent slabs.

* * * * *